US006648684B2

(12) United States Patent
Tang

(10) Patent No.: US 6,648,684 B2
(45) Date of Patent: Nov. 18, 2003

(54) RADIO FREQUENCY CABLE CONNECTOR

(75) Inventor: James Tang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/112,926

(22) Filed: Mar. 29, 2002

(65) Prior Publication Data

US 2003/0082950 A1 May 1, 2003

(30) Foreign Application Priority Data

Oct. 31, 2001 (TW) ..... 90218614 U

(51) Int. Cl.[7] ..... H01R 33/945

(52) U.S. Cl. ..... 439/582; 439/387; 439/578; 439/585

(58) Field of Search ..... 439/582, 578, 439/584, 585, 387, 98, 99

(56) References Cited

U.S. PATENT DOCUMENTS 2,952,823 A * 9/1960 Robinson ..... 439/584
6,331,123 B1 * 12/2001 Rodrigues ..... 439/584
6,468,100 B1 * 10/2002 Meyer et al. ..... 439/320

* cited by examiner

*Primary Examiner*—Tho D. Ta
*Assistant Examiner*—Truc Nguyen
(74) *Attorney, Agent, or Firm*—Wei Te Chung

(57) ABSTRACT

A radio frequency cable connector (1) includes a first element (2) and a second element (3). The first element includes a housing (20), an insulator (21), a central contact (22) surrounded by the insulator, an annular nut (23), a protective lid (24) and a rear cover (25) to enclose a rear portion of the housing. The second element includes a metallic sleeve (30) defining a central through hole (303) and engaging with the housing of the first element, an insulative sleeve (31) accepting a lower portion (302) of the metallic sleeve, and a tail sleeve (32) accepting a lower section (311) of the insulative sleeve. A coaxial cable (10) is received within these three sleeves, a central conductor (100) being connected to the central contact, and a braiding (104) being fixed between the metallic sleeve and the insulative sleeve.

1 Claim, 4 Drawing Sheets

RADIO FREQUENCY CABLE CONNECTOR

BACKGROUND OF THE INVENTION

1. Field of the Invention

The present invention relates to a radio frequency (RF) cable connector, and more particularly to an RF cable connector connecting to a coaxial cable which serves as or feeds an antenna for transmitting and receiving signals in the wireless communication field.

2. Related Art

With reference to FIG. 1, a prior art RF cable connector 4 is disclosed for connecting to a coaxial cable 400. The coaxial cable 400 has a central conductor 410 surrounded by an insulative layer 420, which in turn is surrounded by a braiding layer 430, which is covered by a cable sheath (not labeled).

The prior art connector 4 includes a conductive housing 40 enclosing a contact 401 therein. In assembly, an inner metallic sleeve 42 of the connector encloses the central conductor 410 and insulative layer 420 of the cable 400, and the inner metallic sleeve attaches to the housing 40, with the central conductor 410 electrically connecting to the contact 401 of the connector. A middle metallic sleeve 43 of the connector 4 engages with the inner metallic sleeve 42, fixing the braiding layer 430 therebetween. Furthermore, an outer metallic sleeve 44 is mounted over the middle sleeve 43 and encircles the middle sleeve 43 and the cable 400. Through engagements between an insulative sleeve 45, a tail sleeve 46, the inner sleeve, the middle sleeve and the outer sleeve 44, the cable is fixed to the connector.

However, the process of assembling the cable 400 to the connector 4 is complicated, and the connector is unnecessarily complicated and has too many parts. Thus, productive efficiency is decreased and the cost of manufacture is increased.

An improved RF cable connector including fewer parts is desired.

BRIEF SUMMARY OF THE INVENTION

It is an object of the present invention to provide a radio frequency cable connector having a simpler structure and requiring fewer parts for connecting with a coaxial cable which serves as or is attached to an antenna.

A radio frequency cable connector in accordance with the invention comprises a first element and a second element. The first element includes a housing, an insulator, a central contact fixed in the insulator, an annular nut, a protective lid and a rear cover to enclose a rear portion of the housing. The second element includes a metallic sleeve defining a central bore therethrough, an insulative sleeve, and a tail sleeve. The metallic sleeve engages with the housing of the first element, the insulative sleeve accepts a lower portion of the metallic sleeve therein, and the tail sleeve accepts a lower portion of the insulative sleeve. A coaxial cable is received within these three sleeves, its central conductor connecting to the central contact of the first element, and its braiding being wedged between the metallic and the insulative sleeves. With this arrangement, only the metallic and insulative sleeves are required to fix the cable to the housing of the first element, without the aid of the middle and outer sleeves of the prior art.

Further objects and advantages of the present invention will become more apparent from a consideration of the drawings and the following detailed description.

DESCRIPTION OF THE PREFERRED EMBODIMENT

Figure 1:
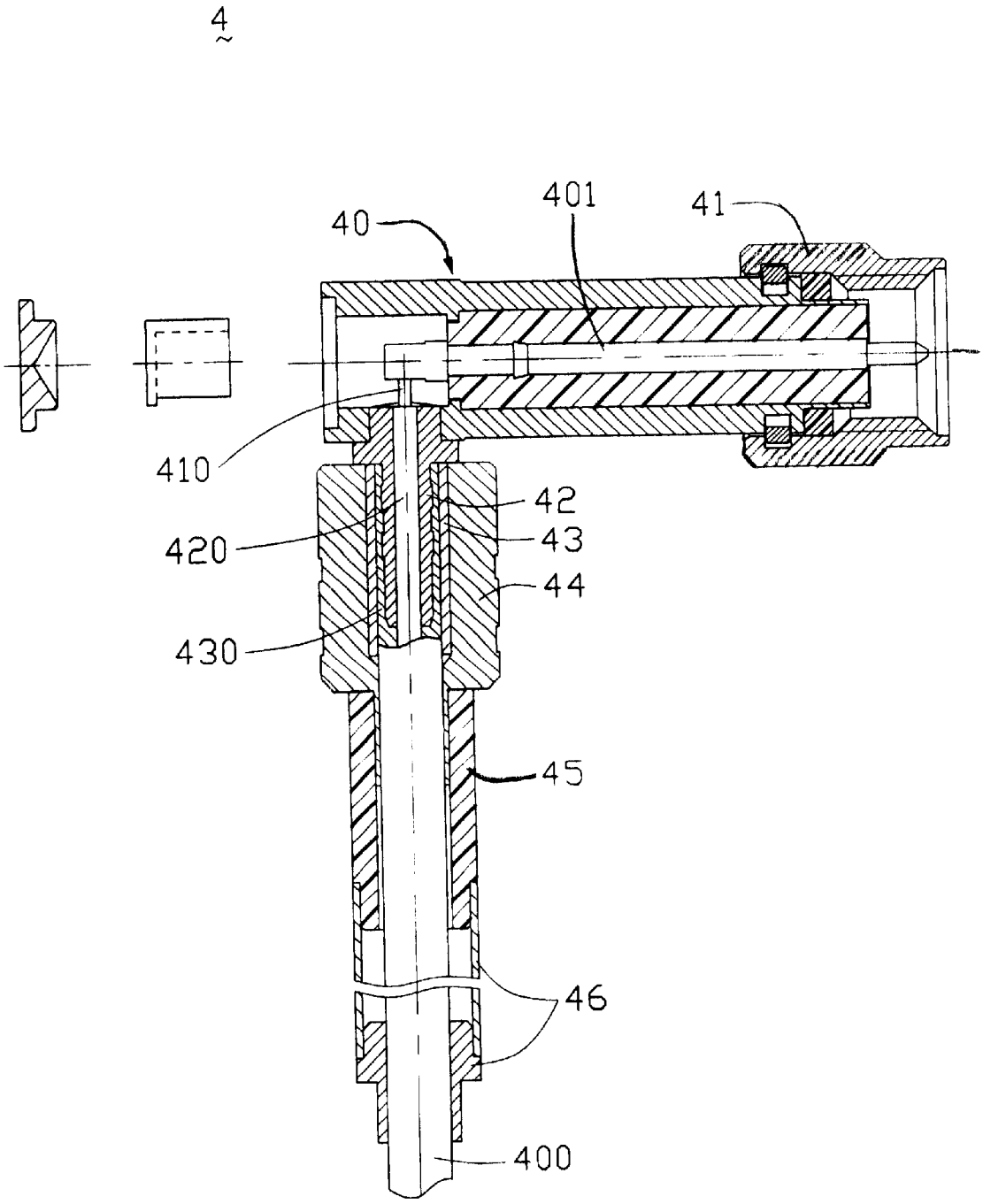
FIG. 1 (PRIOR ART)
FIG. 1 is a cross-sectional, partially assembled view of a prior art RF cable connector.
Figure 2:
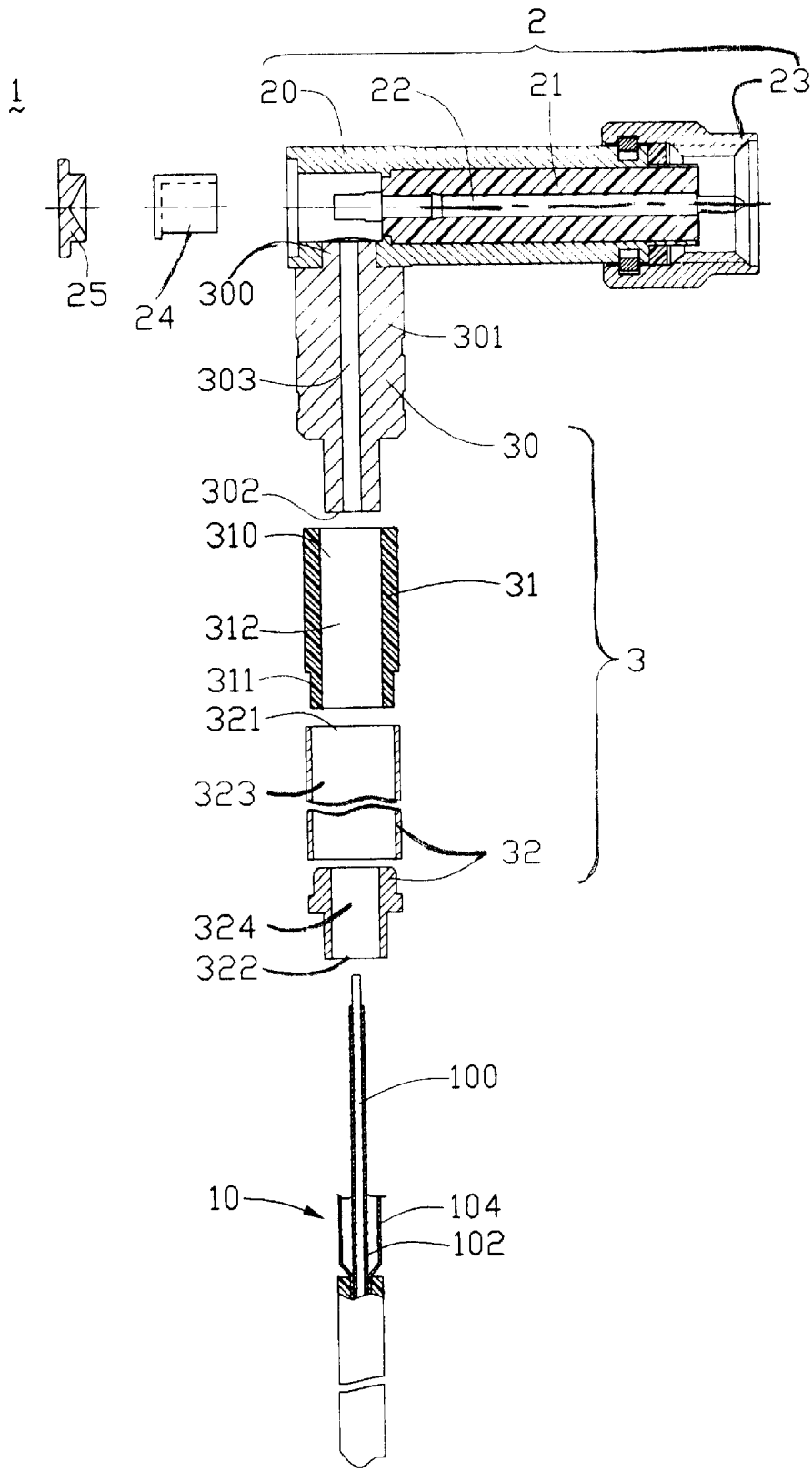
FIG. 2 is an exploded, cross-sectional view of a radio frequency cable connector in accordance with a preferred embodiment of the present invention.
Figure 3:
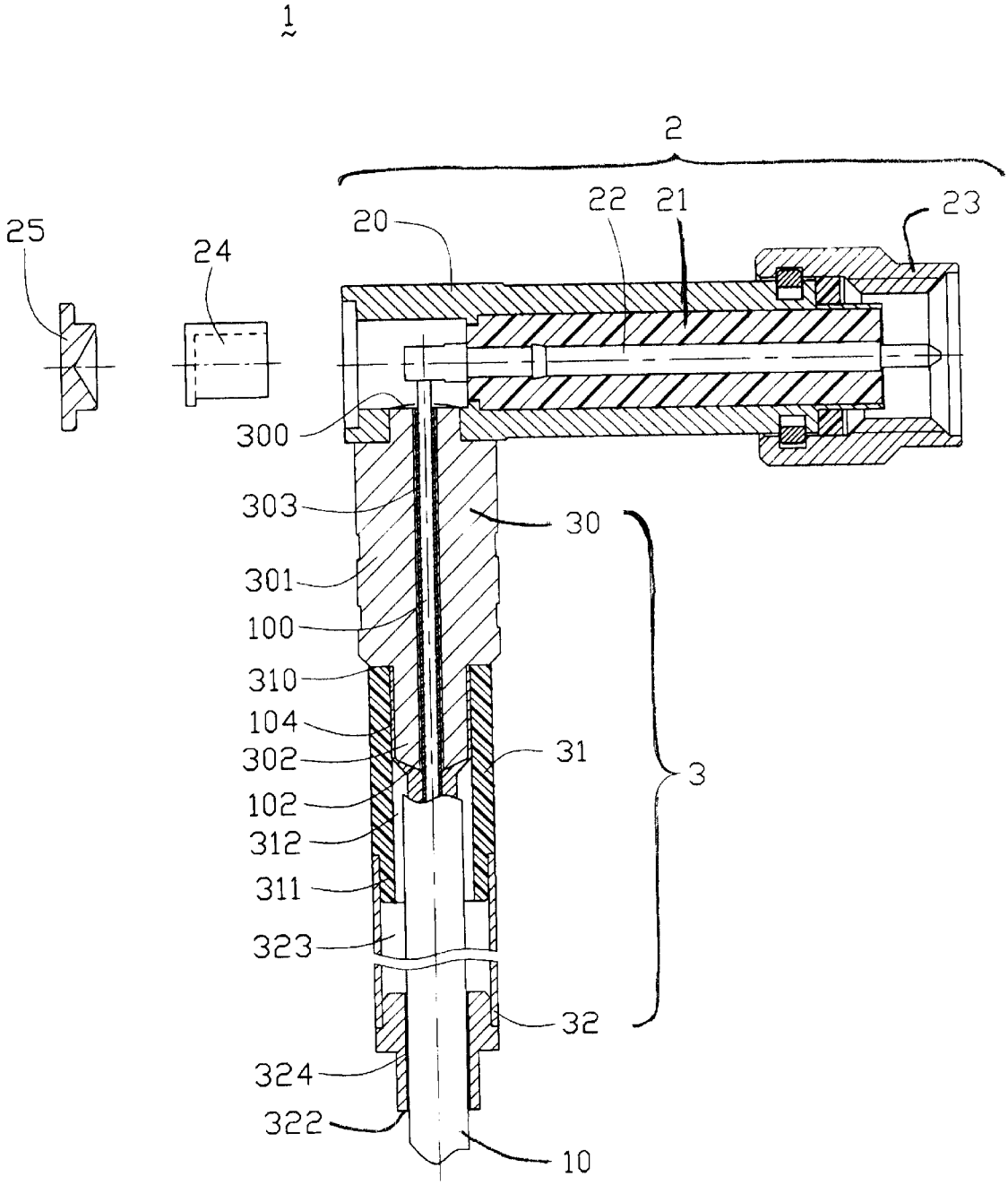
FIG. 3 is a partially assembled view of FIG. 2.

Referring to FIGS. 2 and 3, a radio frequency cable connector 1 in accordance with a preferred embodiment of the present invention comprises a first element 2 and a second element 3. The first element 2 includes a conductive housing 20, an insulator 21 inside the housing, a central contact 22 fixed in the insulator 21, an annular nut 23, a protective lid 24 and a rear cover 25. The second element 3 includes a metallic sleeve 30, a hollow insulative sleeve 31 accepting a lower portion of the metallic sleeve 30, and a two-part tail sleeve 32 accepting a lower section of the insulative sleeve 31.

The housing 20 has a cylindrical shape and encircles the insulator 21. The housing 20 defines a front and rear openings (not labeled), and defines a hole (not labeled) in a rear lower surface thereof.

Figure 4A:
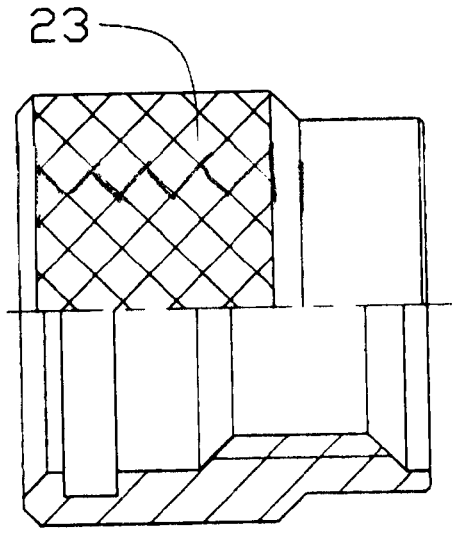
FIG. 4A is a partially cross-sectional view of a nut of the cable connector of FIG. 3, showing a rhomboidal pattern of knurls on the nut.
Figure 4B:
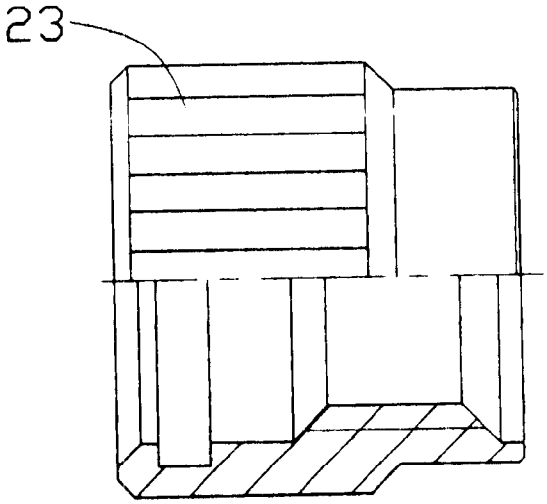
FIG. 4B is similar to FIG. 4A but showing a parallel pattern of knurls on the nut.

The annular nut 23, in the shape of a short cylinder, is disposed over the front opening of the housing 20 and can be rotated to engage with a complementary connector which connects to a printed circuit board. Referring to FIGS. 4A and 4B, a plurality of rhomboidal knurls, or, alternatively, parallel knurls, are inscribed in an outside surface of the annular nut 23. The details of assembling the nut 23 to the housing 20 are well known by those skilled in the art, so a detailed description of associated elements is omitted here.

The protective lid 24 is made of insulative material and the rear cover 25 is made of metal. The protective lid 24 fits in the rear opening of the housing 20 and the rear cover 25 closes the rear opening.

The metallic sleeve 30 includes an upper portion 300, a middle portion 301, and a lower portion 302, each having different diameters. A through hole 303 is defined through a center of the metallic sleeve 30. In assembly, the metallic sleeve 30 is mounted perpendicularly to the housing 20, the upper portion 300 extending into the hole (not labeled) of the housing 20 but not extending beyond an inner wall of the housing 20. Both the upper portion 300 and the lower portion 302 are a little narrower than the middle portion 301.

The hollow insulative sleeve 31 includes an upper section 310 and a lower section 311, and defines a through hole 312 along a longitudinal axis. An interior diameter of the upper section 310 of the insulative sleeve 31 is approximately equal to an external diameter of the lower portion 302 of the metallic sleeve 30 whereby the lower portion 302 can be inserted into the upper section 310. The lower section 311 is a little narrower than the upper section 310.

The hollow tail sleeve 32 includes two metallic pieces, the two pieces being an upper segment 321 and a lower segment 322. The upper segment 321 can alternatively be made of an insulative material. The lower segment 322 can alternatively be made of a resilient material, such as rubber or plastic. An upper through hole 323 is defined through the upper segment 321, and a lower through hole 324 is defined through the lower segment 322. An interior diameter of the upper segment 321 of the tail sleeve 32 is approximately equal to an external diameter of the lower section 311 of the insulative sleeve 31 whereby the lower section 311 can be inserted into the upper segment 321. The lower segment 322 is a little narrower than the upper segment 321 and fits snuggly within the upper segment 321.

A coaxial cable 10 includes a central conductor 100, surrounded by an insulative layer 102, which is surrounded by a conductive braiding 104, which is further surrounded by a dielectric cable sleeve (not labeled). When the cable 10 is assembled to the connector 1, a length of the cable sleeve (not labeled) is stripped from the end of the cable that is to be assembled to the connector 1. A shorter length of the braiding 104 is also stripped off, and a yet shorter length of the insulative layer 102 is stripped off from the central conductor 100. Thus, lengths of central conductor 100, insulative layer 102 and braiding 104 will be visible on the stripped cable. The length of braiding extending outside the cable sleeve is loosened from the insulative layer 102 so that it can fit around the lower portion 302 of the metallic sleeve 30. The cable end consisting of the bare central conductor 100 and bare insulative layer 102 is then inserted through the through hole 303 of the metallic sleeve 30, so that an end of the insulative layer 102 is roughly even with an end of the upper portion 300 of the metallic sleeve 30 and the bare central conductor 100 protrudes beyond the upper portion 300. An end of the bare central conductor 100 is soldered or otherwise electrically connected to the central contact 22 in the housing 20. The braiding 104 is then arranged around the lower portion 302 of the metallic sleeve 30 and the upper section 310 of the insulative sleeve 31 is pushed onto the lower portion 302 of the metallic sleeve 30, wedging the braiding 104 between the metallic sleeve 30 and the insulative sleeve 31. The tail sleeve 32 accepts the lower section 311 of the insulative sleeve and the inner wall of the tail sleeve 32 tightly engages the cable sleeve.

When correctly configured, the coaxial cable 10 can serve as an antenna for transmitting and receiving signals, or it can attach to an antenna. Accordingly, the second element 3 of the present invention, in normal use, will be disposed outside of an outer surface of an electronic device, for example, a computer.

In comparison with the prior art, the present invention replaces the middle metallic sleeve, the outer metallic sleeve, and the insulative sleeve of the prior art with just the insulative sleeve 31 of the present invention. Therefore, production efficiency is increased and manufacturing cost is decreased.

Although the invention has been described in conjunction with a particular embodiment, it is quite obvious that it is in no way limited thereto and that various alternatives and modifications can be made to it without in any way departing either from its scope or its spirit.

I claim:

1. A radio frequency cable connector assembly comprising:

a first element including coaxial central contact and outer conductive housing separated from each other with first insulator;

a cable including coaxial central conductor and a braiding layer with another coaxial insulative layer therebetween;

a second element attached to a rear portion of said first element at a right angle, said second element including:

a metallic sleeve defining upper and lower portions with a shoulder therebetween, an upper end of said upper portion attached to a rear portion of the conductive housing;

an insulative sleeve with an upper edge located on the shoulder, an upper portion of said insulative sleeve enclosing the lower potion and exposed to an exterior circumferentially;

wherein said central conductor extends through both the insulative sleeve and said metallic sleeve and mechanically and electrically connects to the central contact, and said braiding layer is sandwiched between the lower portion and the insulative sleeve; and wherein a first axial dimension of said upper portion is similar to an axial dimension of the insulative sleeve; and wherein a second axial dimension of said lower portion is about one half of the axial dimension of the insulative sleeve.

* * * * *